United States Patent [19]

Yasujima et al.

[11] 4,063,211

[45] Dec. 13, 1977

[54] METHOD FOR MANUFACTURING STABLE METAL THIN FILM RESISTORS COMPRISING SPUTTERED ALLOY OF TANTALUM AND SILICON AND PRODUCT RESULTING THEREFROM

[75] Inventors: Nobuo Yasujima, Kawagoe; Natsuo Itokawa, Manba; Juichiro Arai, Matsudo, all of Japan

[73] Assignees: Taisei Denski Kabushiki Kaisha, Manba; Nobuo Yasujima, Kawagoe, both of Japan

[21] Appl. No.: 618,618

[22] Filed: Oct. 1, 1975

Related U.S. Application Data

[63] Continuation-in-part of Ser. No. 422,920, Dec. 7, 1973, abandoned.

[30] Foreign Application Priority Data

Oct. 9, 1972 Japan ..... 47-123046

[51] Int. Cl.[2] ..... H01C 1/012; C23C 15/00

[52] U.S. Cl. ..... 338/308; 75/174; 204/192 F; 428/457

[58] Field of Search ..... 204/37 R, 38 A, 192, 204/192 F; 75/174; 338/254, 262, 308; 428/457, 209; 148/6.3

[56] References Cited

U.S. PATENT DOCUMENTS

| | | | |
|---|---|---|---|
| 3,738,919 | 6/1973 | Chilton et al. | 204/192 |
| 3,790,913 | 2/1974 | Peters | 75/174 X |

OTHER PUBLICATIONS

Journal of Electrochemical Society, vol. 121, Apr. 1974, pp. 550–555.

*Primary Examiner*—C. Lovell

[57] ABSTRACT

A method for manufacturing a highly stable metal thin film resistor including a substrate having deposited thereon a sputtered tantalum-silicon alloy film containing from 50–72 atomic percent of silicon, comprising heating the as-sputtered amorphous film to a temperature of between 500° C and 750° C for a time period of from 1 to 60 minutes in an ambient atmosphere of air or oxidizing gas or in an ambient atmosphere of inert gas or a vacuum. The as-sputtered film becomes completely crystallized, and a tantulum -silicon alloy thin film resistor which is high in stability, high in specific resistance and has a low temperature coefficient of resistance is obtained.

6 Claims, 8 Drawing Figures

Resistance (kΩ)
10.0
9.0
8.0
7.0
6.0
5.0
4.0
3.0
2.0
1.0
Temperature (°C)
900
800
700
600
500
400
300
200
100
0
(iv)
(i)
(iii)
(ii)
0
1
2
3
Heat treatment time (min)

ΔR/R (%)
5
1
0.5
0.1
0.05
0.01
0.005
0.001
(C)
(B)
(A)
10
50
100
500
1000
5000
Time (hrs)

METHOD FOR MANUFACTURING STABLE METAL THIN FILM RESISTORS COMPRISING SPUTTERED ALLOY OF TANTALUM AND SILICON AND PRODUCT RESULTING THEREFROM

REFERENCE TO A COPENDING APPLICATION

This invention is a continuation-in-part of copending application Ser. No. 422,920, filed Dec. 7, 1973 and now abandoned.

FIELD OF THE INVENTION

This invention relates to a method for manufacturing a highly stable thin film resistor comprising sputtered alloy of tantalum and silicon and to products resulting therefrom. More particularly, this invention relates to a method for manufacturing a highly stable resistor having a high specific resistance by sputtering tantulum and silicon onto a substrate to form an amorphous thin film of high resistivity and heat treating the film to completely crystallize the same.

PRIOR ART

Recently, with the development of electronic instruments, electric parts of smaller size and higher performance have been greatly required. Electric resistors are no exception to such requirements, and have been continuously advanced toward higher performance and higher reliability. We will briefly review the history of advance of resistors. At the initial stage, solidstate resistors and carbon film resistors became widely used and their use increased rapidly. However, with the advancement of electronic instruments, resistors of higher precision and superior characteristics were required, and research and development for various resistors were carried out. As a result, some types of resistors such as cermet of Cr-Sio, metal oxide film and metal thin film took place. Among them, metal thin film resistors of Ni-Cr class, which are adequately balanced in operational characteristics and stability, have been widely used up to now. Beside these types, tantalum nitride type has appeared as a resistor of high stability satisfactory to the requirements of high level specifications.

When comparing carbon resistors and Ni-Cr class metal resistors, the latter is extremely superior in stability as well as in characteristics of current noise and temperature coefficent of resistance, but on the other hand it has the drawback that sufficiently high resistance is difficult to be realized. The tantalum nitride thin film resistor is a resistor which is superior in stability to the Ni-Cr class resistors. This tantalum nitride thin film resistor has a favorable temperature coefficient of resistance but it has a specific resistance of only about 260 $\mu\pi$ cm and an area resistance of only 50–200$\pi$/cm$^2$ for a practical film thickness thereof. The formation of this film is easy due to the fact that there is a so-called plateau region wherein the foregoing characteristics can bearly be obtained by effecting a reactive sputtering under a nitrogen partial pressure of $5 \times 10^{-5} - 1 \times 10^{-3}$ Torr. But on the other hand, there is the deficiency that it is difficult to produce a resistor of high resistance value. Additionally, although extremely high mechanical strength can be obtained since tantalum forms an interstitial solid solution with nitrogen of small atomic radius, there is a problem with respect to the stability in electric characteristics at the time of high load or high temperature. Specific resistance and the stability of resistors depend on the property of the substance, and the history of research and development of resistors may be said to be the history of research of the property of the substances thereof.

SUMMARY OF THE INVENTION

In accordance with the present invention, the prior art limitation referred to the above has been successfully obviated.

Accordingly a principal object of the invention is to provide a metal thin film resistor which is high in stability, high in specific resistance and has a small temperature coefficient of resistance by sputtering semiconductor single crystal silicon and tantalum to form an amorphous film of high specific resistance and heat treating the as-sputtered film to completely crystallize the film to form a tantalum-silicon substitution solid solution.

This is accomplished in the present method for manufacturing a stable metal thin film resistor consisting of a sputtered tantalum-silicon alloy film containing from 50 to 72 atomic percent of silicon deposited upon a substrate, which comprises heat treating the sputtered amorphous film at a temperature within the range of 500°–750° C for a time period ranging from 1 to 60 minutes in an ambient atmosphere selected from the group consisting of air, an oxidizing gas, an inert gas and a vacuum of no more than $10^{-5}$ Torr, to thereby completely crystallize said sputtered film.

DETAILED DESCRIPTION OF THE INVENTION

Hereinbelow the present invention will be described in detail in connection with the appended drawing.

The resistor according to the invention is a tantalum-silicon alloy thin film resistor which is manufactured by sputtering tantalum-silicon alloy upon a substrate and contains 50–72 atomic percent of silicon.

Figure 1:
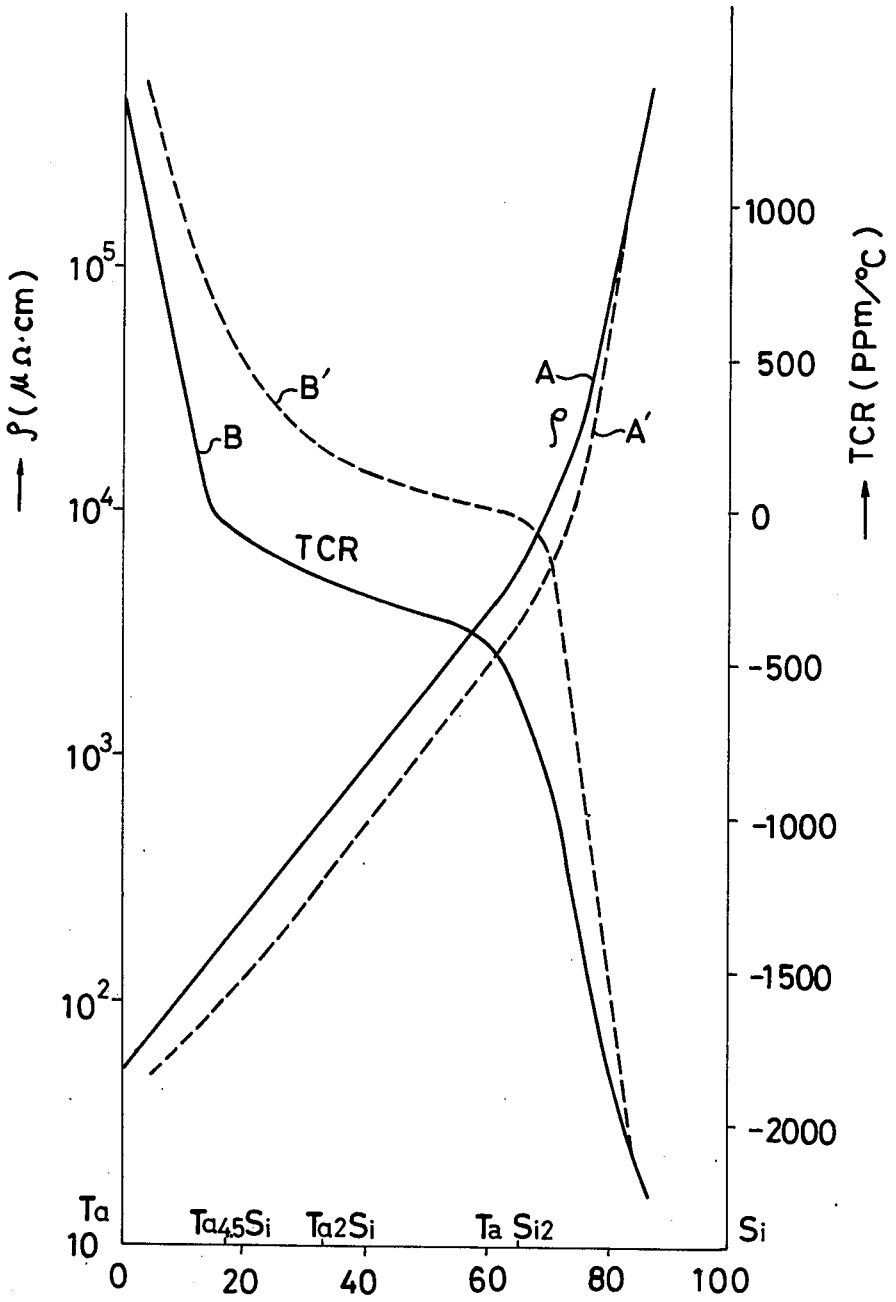
FIG. 1 is a graph showing the relation of the specific resistance value and the temperature coefficient of resistance with respect to the silicon ratio in the tantalum-silicon alloy thin film resistor.

Referring to the drawing, curve A in FIG. 1 shows specific resistance $\rho$ ($\mu\pi$cm) and curve B temperature coefficient of resistance TCR (ppm/° C) for various atomic percentage of silicon in relation to tantalum.

As can be seen from FIG. 1, the specific resistance increases nearly linearly for amounts of silicon ranging from zero to 67 atomic % which is equivalent to $TaSi_2$, and steeply increases thereafter.

Concurrently, the temperature coefficient of resistance TCR sharply decreases linearly when the amount of silicon ranges from zero to 18 atomic % which corresponds to $Ta_{4.5}Si$ (see R. Kieffer et al.:Z. Metallkunde, 44, 242/246, 1953), then gradually decreases and suddenly drops to assume a large negative value near about 67 atomic %, which is equivalent to $TaSi_2$.

From the above, it is found that the thin film tantalum-silicon alloy resistor has an extremely high value of specific resistance.

Furthermore, if viewed in regard to the temperature coefficient of resistance, TCR, it can be seen that the thin film tantalum-silicon alloy containing silicon in an amount ranging from about 15% to about 60% in atomic ratio is generally constant in TCR.

Next, one embodying example for the manufacture of the thin film tantalum-silicon alloy resistor will be given.

The sputtering condition for the manufacture of a sample is effected by evacuating a stainless steel belljar of 450 mm diameter to a maximum attainable vacuum degree of $3 \times 10^{-7}$ Torr., and introducing high purity argon therein through a leak valve to a pressure of $18\text{–}20 \times 10^{-3}$ Torr. Under these conditions a bipolar sputtering is effected on a ceramic substrate plate with a cathode voltage of $-5.7 - 6.5$ KV, a current density of 0.2 – 0.5 mA/cm$^2$, a film forming speed of 50 – 150 A/min. and a distance of 9 cm between the target and the anode.

Variation of the film composition is effected by varying the ratio of the areas of the silicon plate and the tantalum plate of the cathode. The silicon plate is formed as a single crystal of semiconductor silicon sliced along its (III) plane. The film composition is determined by an X-ray microanalyzer.

The characteristic features of the thin film tantalum-silicon alloy resistor thus produced by co-sputtering tantalum and silicon on the substrate are as shown in FIG. 1.

The curves A′, B′ in FIG. 1 show the characteristic features of resistors in which the foregoing tantalum-silicon alloy thin films have been heat treated at 650° C for 30 minutes in a vacuum. The noteworthy feature here is that the wide range of variation between the curves B and B′ before and after the heat treatment includes zero and the vicinity thereof of the temperature coefficient of resistance TCR.

Figure 2:
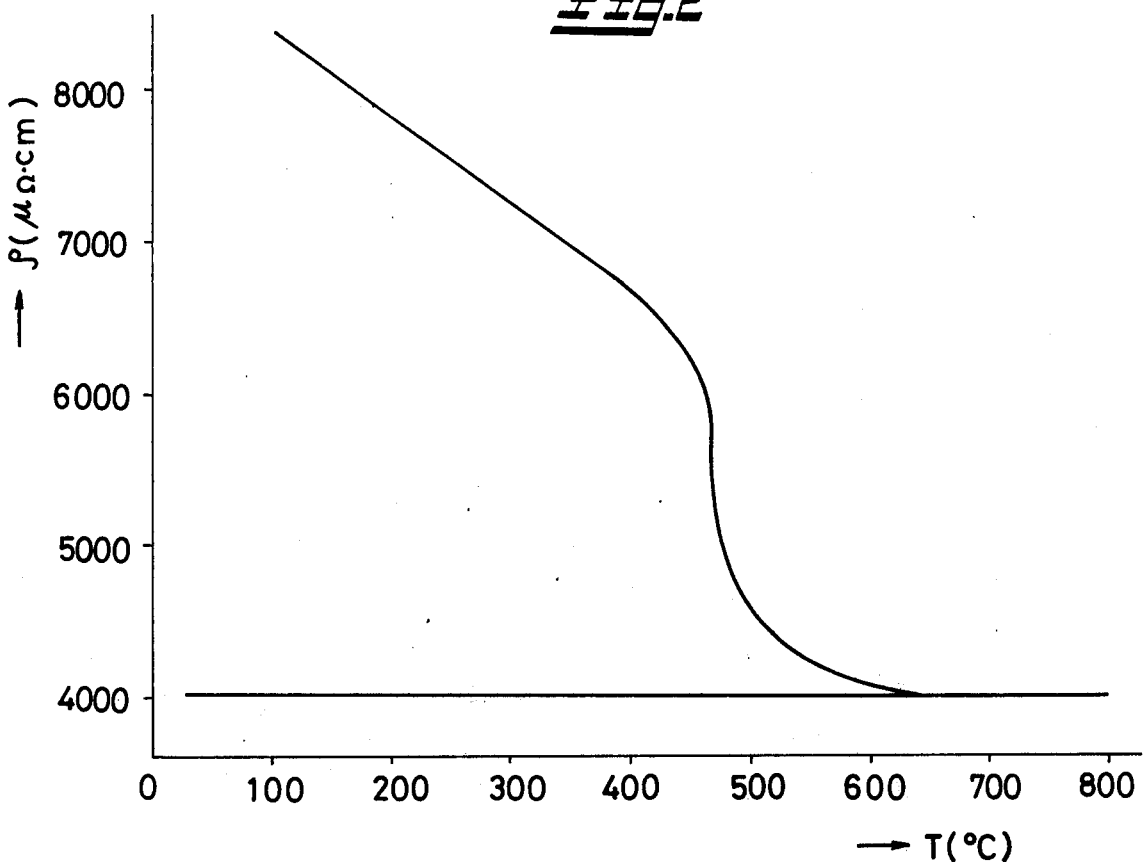
FIG. 2 is a graph showing the change of the specific resistance value in relation to the heat treatment temperature of the resistor of FIG. 1 in which silicon is present in an amount of 67 atomic %, FIG. 3(*a*) is a graph showing the change of resistance value and the temperature rise of the resistor of FIG. 1 containing 67 atomic % of silicon with respect to the heat treatment time period of the resistor, FIG. 3(*b*) is a graph showing the change of resistance value and the temperature rise of various prior art resistors with respect to the heat treatment time period of the resistor, FIGS. 4(*a*) and 4(*b*) are diagrams showing X-ray diffractograms of the resistor of FIG. 1 containing 67 atomic % of silicon before the heat treatment and after the heat treatment respectively.

FIG. 2 shows a continuous record of the change of specific resistance value when a sample having a silicon content of 67 atomic % (equivalent to $TaSi_2$) is heated at a temperature rise rate of 15° C/min within a vacuum of $5 \times 10^{-6}$ Torr. As shown in FIG. 2, the resistance value sharply decreases between about 450 and 500° C and thereafter becomes constant, and this value remains almost unchanged until the sample reaches a normal temperature. This shows that the temperature coefficient of resistance TCR becomes $-82$ ppm/° C.

Here, the effect of the heat treatment time period is different from that for bulk-shaped metals or compounds. The growth of crystal in a thin film is so rapid as to be completed almost at the same time when the corresponding temperature is reached and thereafter shows little change.

A characteristic method of heat treatment of the invention is as follows. To a resistor formed by sputtering in the same manner as above described there are provided terminals of nonoxidizable and non-diffusable metal, such as Pt-Ti for example, or of metal which is non-diffusable and easily eliminatable of oxide film thereof, such as Ni-P for example. Then the resistor with terminals is heat-treated in air or an oxidizing atmosphere under a pressure of 1 atm at 500°–750° C. By this, an effect as can be obtained similar to that by the heat treatment in a vacuum or in an inert gas ambient atmosphere in the above described embodiment.

Figure 3:
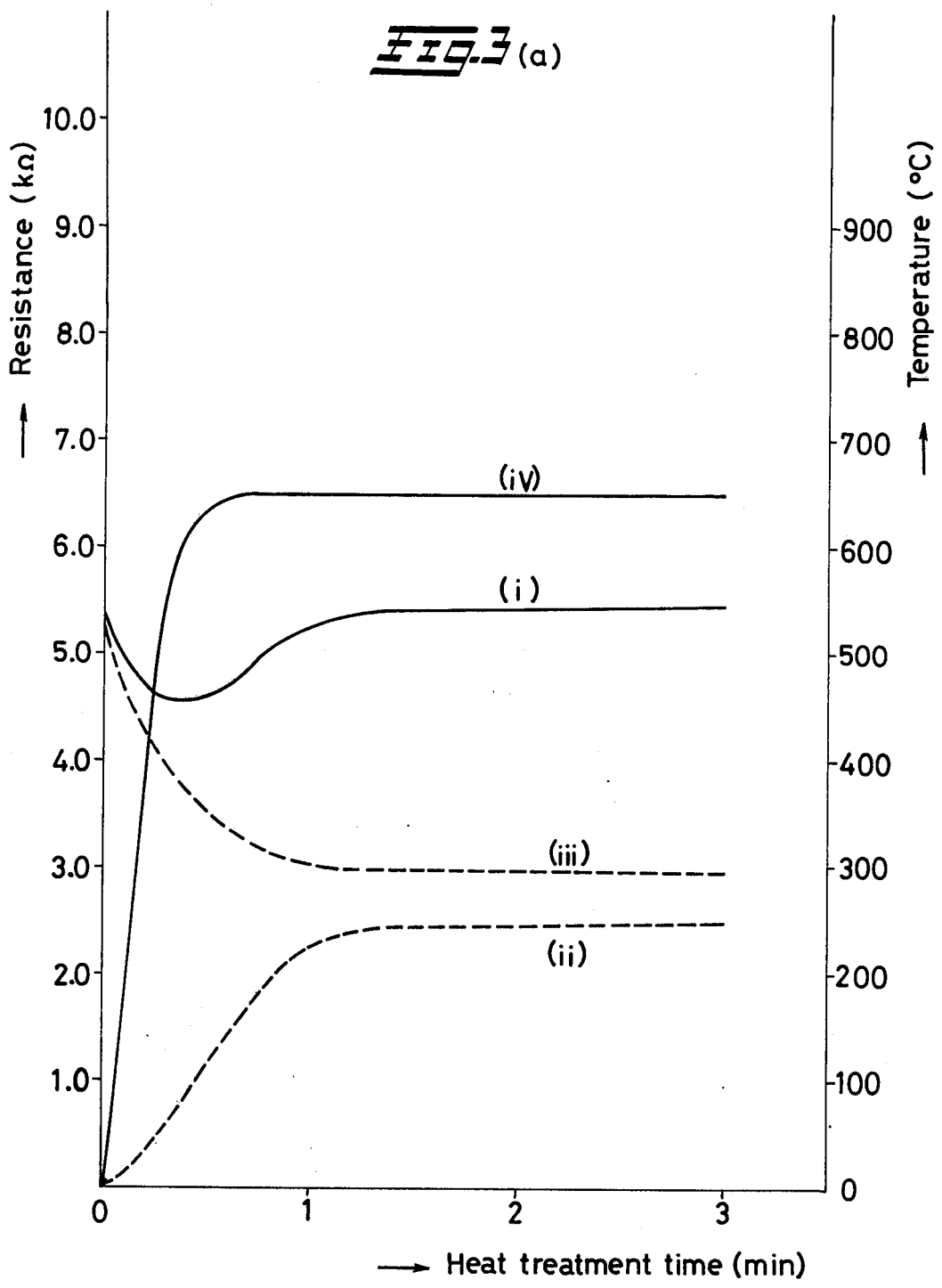
Figure 3:
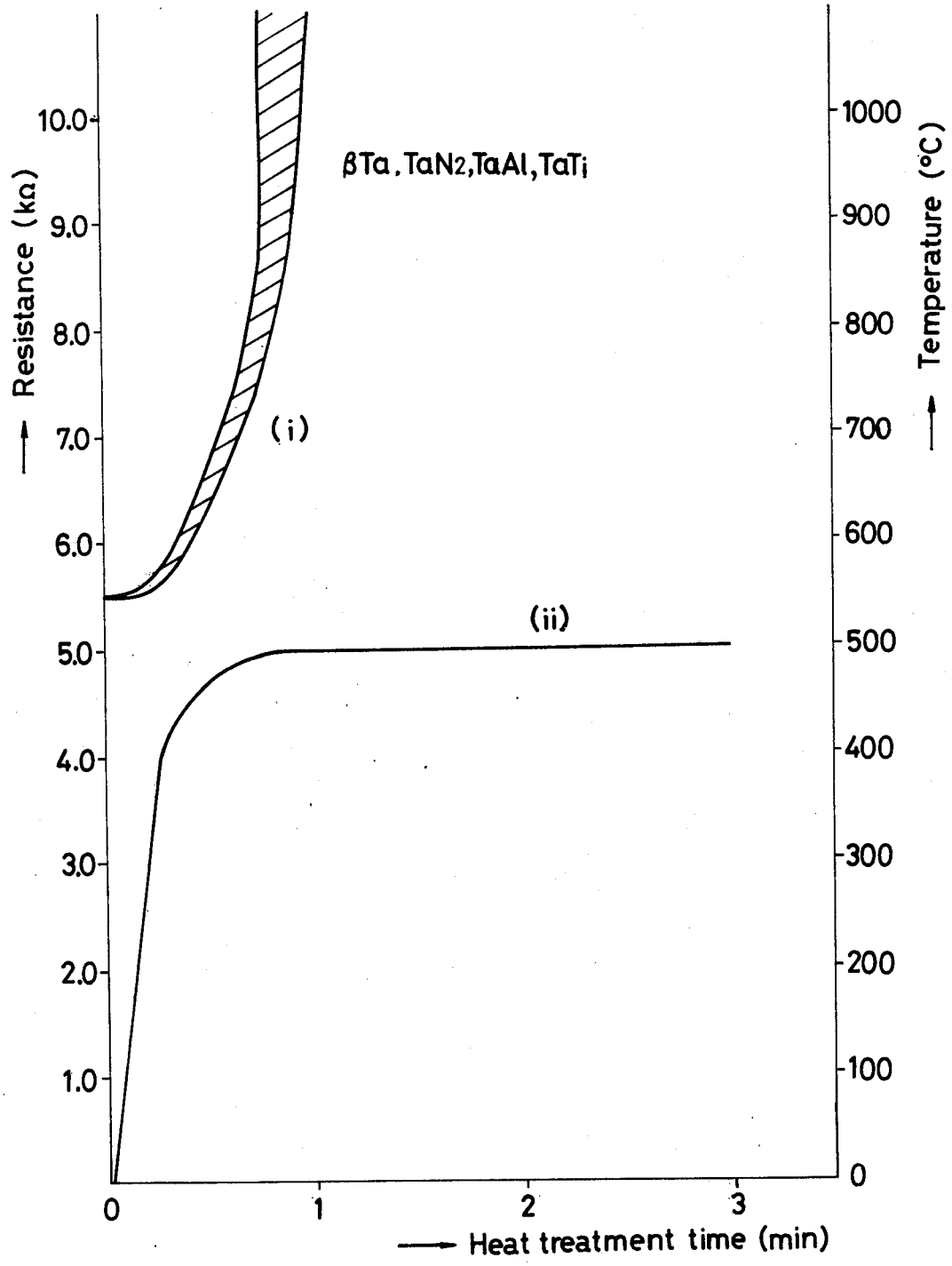

An example of said characteristic method is shown in FIG. 3(*a*). A resistor is put into a furnace of a temperature of 650° C, and the resistance value change $\Delta$ R/R is measured with a self-recorder. The sample resistor used is the similar resistor as in FIG. 1 which contains silicon of 67 atomic % (equivalent to $TaSi_2$). Curve (i) shows the observed value, and curve(iv) shows the temperature rise of the resistor. Curve(iii) shows an anticipated resistance value change according to crystallization, and curve(ii) shows an assumed increase of resistance value due to the oxidation of the surface of the thin film which may take place when the film is heated in air. The observed value curve(i) may be considered as the result of the combination of said latter two curves. Curve(i) shows that, after the initial change, the resistance value does not change with respect to the time.

FIG. 3(*b*) shows the resistance value change $\Delta$ R/R with respect to the heat treatment time of the prior art films of $\beta$ tantalum, tantalum nitride, tantalum-aluminum and tantalum-titanium when they are heated in air. As is apparent from the figure, film resistors of these metals and alloys are easily oxidized, and their resistance value changes are all involved in the region of(i) in FIG. 3(*b*). Accordingly, these prior art films are rapidly oxidized by the heat treatment in air, and become unsuitable for practical use.

As is understood from the above description tantalum-silicon alloy film according to the invention has an extremely high non-oxidization property. Such non-oxidization property of the alloy of the invention is considered to be due to the very thin oxide layer produced on the surface of the tantalum-silicon alloy thin film which may contribute to protect the inside alloy and prohibit oxygen atoms from diffusing inside. This characteristic feature has been found by the inventors for the first time. Accordingly, the tantalum-silicon thin film of the invention has the remarkable advantage that it can be heat treated in air or oxidizing atmosphere and does not need a vacuum or inert gas atmosphere.

As is apparent from FIG. 3(*a*), with the tantalum-silicon alloy thin film of the invention, the heat treatment effect of recrystallization can be almost completed in about 1 minute when the film reaches the furnace temperature, similarly as in the case of the above described vacuum heat treatment. This time period of 1 minute is the time consumed for the temperature increase of the film. After this, little change is observed. Too great a period of heat treatment is undersirable from the view of manufacturing efficiency. 60 minutes maximum is preferable. Accordingly, the preferred heat treatment time is 1–60 minutes.

In the heat treatment in air, the observed specific resistance value is slightly higher than that observed in the heat treatment in a vacuum, but the change of temperature coefficient of resistance is slight.

Figure 4:
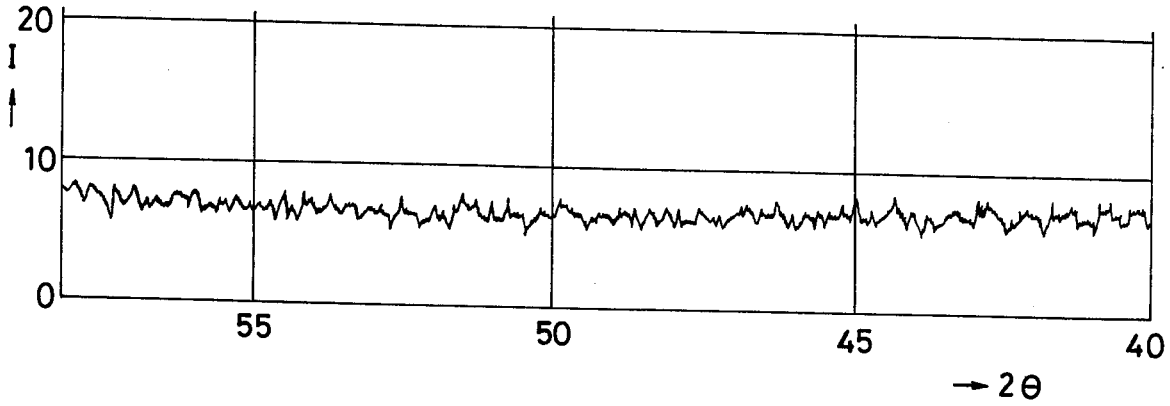
Figure 4:
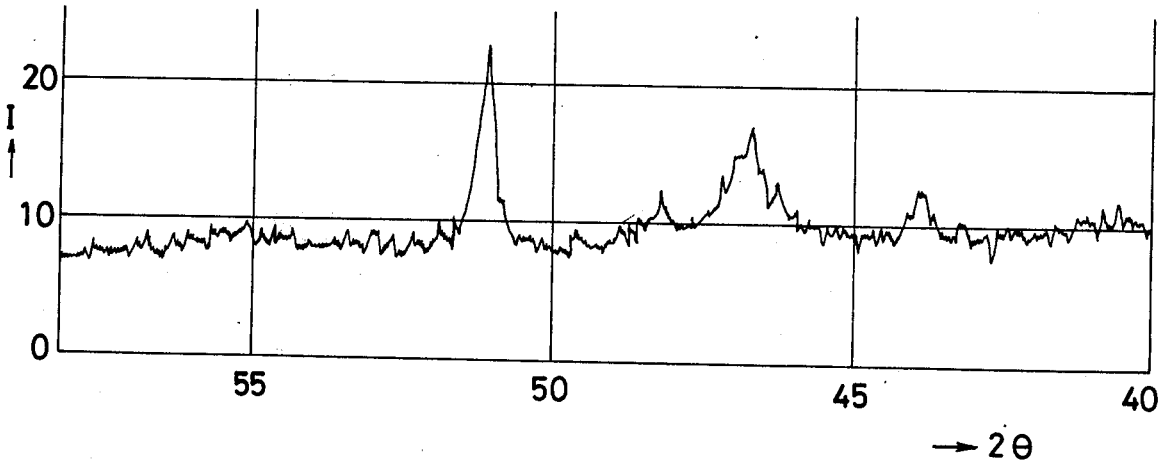

FIGs. 4(*a*) and 4(*b*) show diffractograms of the sample of FIG. 2 obtained by an X-ray diffractometer. In these figures, the diffraction angle of 2 $\theta$ is plotted as the abscissa and the diffraction intensity of I is plotted as the ordinate. FIG. 4(*a*) represents the sample before the heat treatment, where there cannot be observed any diffraction by a crystal surface and accordingly it can be known that the sample is amorphous. FIG. 4(*b*) represents the sample after the heat treatment, where it is clearly observed that the crystallization of the sample has completely progressed. With this, it can be interpreted that the resistance value change between 450°–650° C in FIG. 2 shows the progress of crystallization.

A further embodying example which will show the high stability of the tantalum-silicon alloy thin film resistor according to the invention will be given below.

Figure 5:
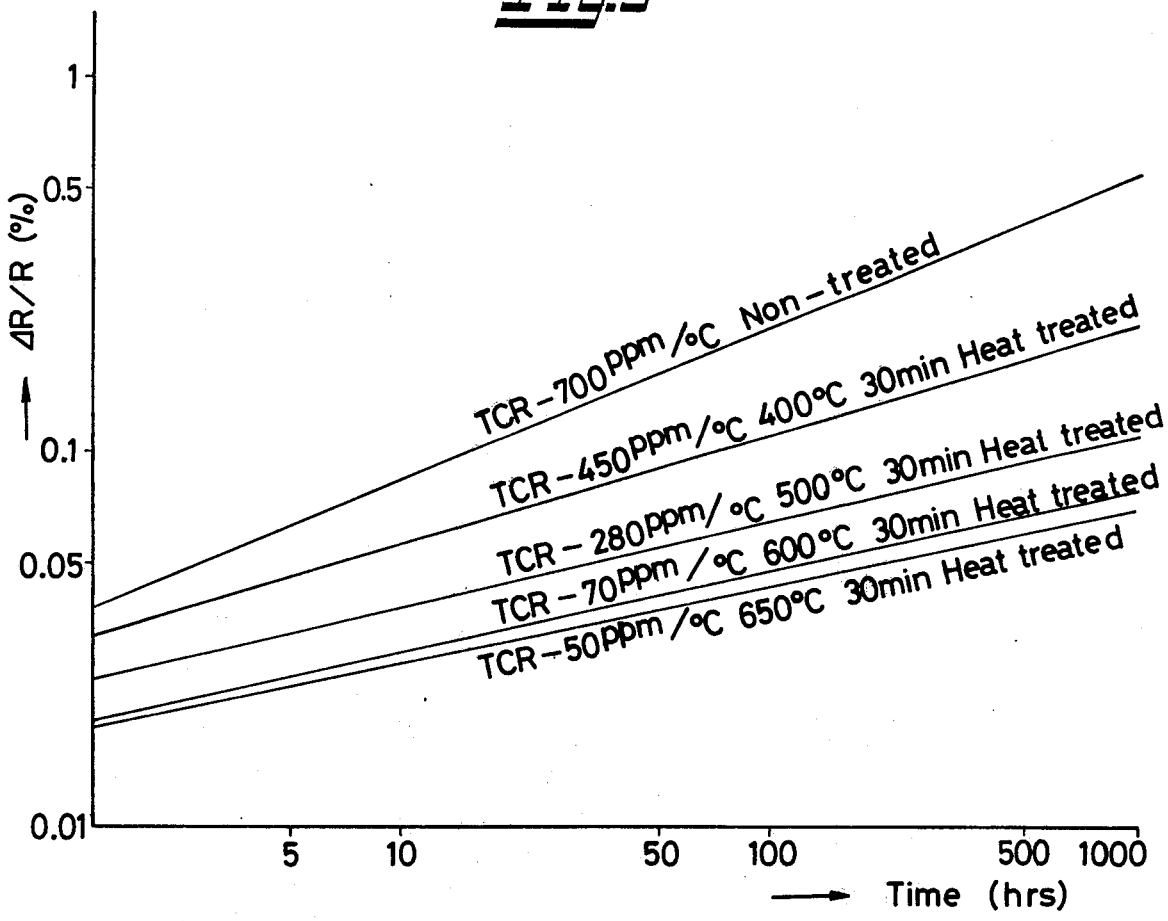
FIG. 5 is a graph showing the temperature coefficient of resistance and the result of high temperature shelf stability test in an ambient atmosphere of 150° C with respect to the resistor of FIG. 1 containing 67 atomic percent of silicon which has been heat treated for 30 minutes in a vacuum.

Sample resistors are used similar to the resistors in FIG. 1 containing silicon of 67 atomic %(equivalent to $TaSi_2$), which are heat treated for 30 minutes in a vacuum. The temperature coefficient of resistance and the results of high temperature shelf test of these heat treated samples are shown in FIG. 5. As is apparent from the figure, a sample which has been heat treated at 650° C for 30 minutes in a vacuum is about ⅛ in the change ratio $\Delta$ R/R of temperature coefficient of resistance as compared to a non-heat treated sample. The effect of heat treatment becomes smaller as the treatment temperature increases. For a temperature above 650° C, further change in the change ratio $\Delta R/R$ is not observed, only the temperature coefficient of resistance TCR changing slightly.

Thus, for obtaining a highly stable resistor of tantalum-silicon alloy thin film, which is the main characteristic feature of the invention, a heat treatment for complete crystallization is indispensable. Accordingly, for obtaining substantially complete crystallization and a desired low value of temperature coefficient of resistance of the tantalum-silicon alloy thin film, it is necessary to heat treat at a temperature of 500° C or above, preferably in the range of 500°–750° C. 750° C is the upper limit in practical work considering terminal members of ordinary use.

Figure 6:
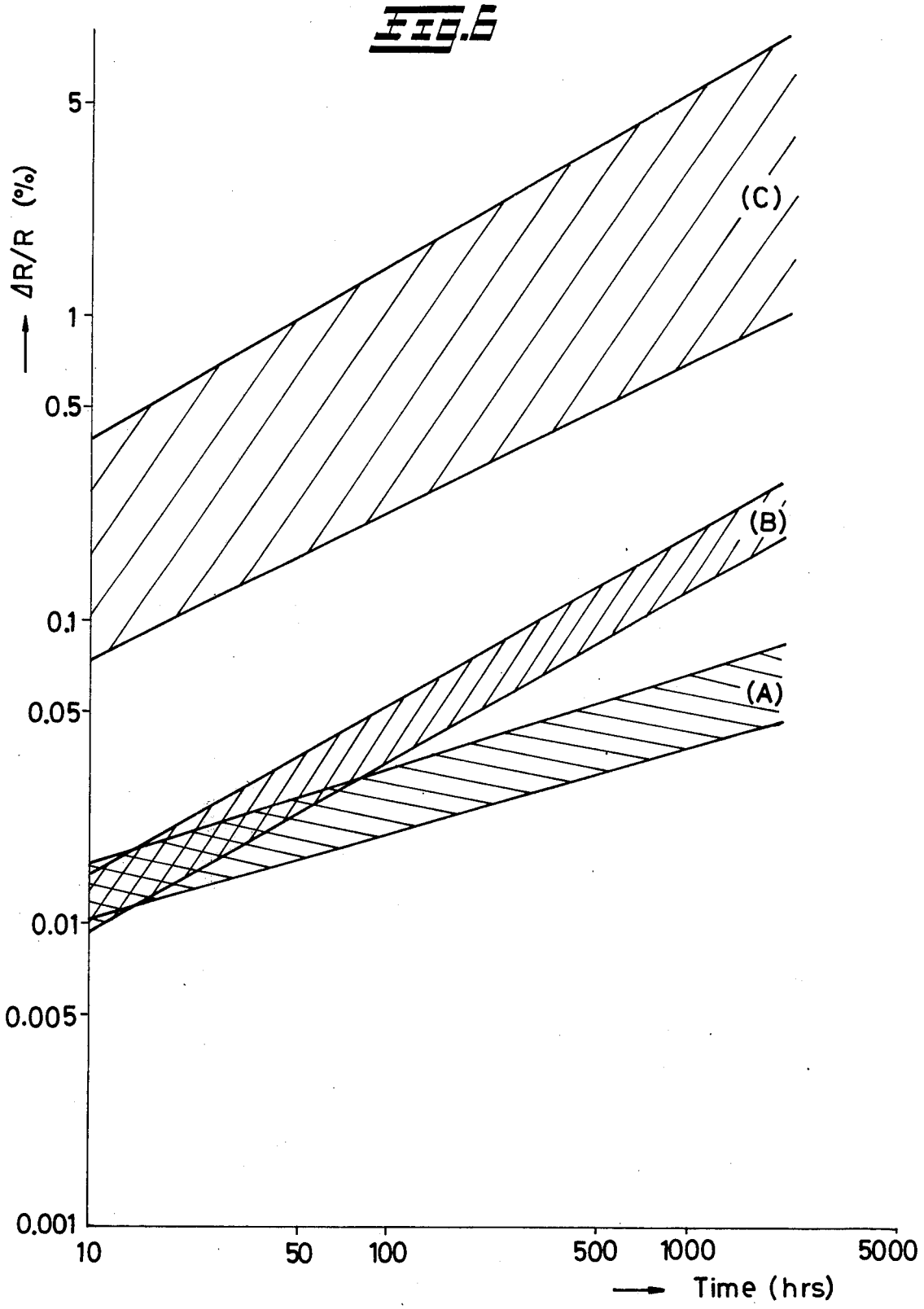
FIG. 6 is a graph showing in comparison the results of high temperature shelf stability tests of various prior art resistors and the tantalum-silicon resistor containing 67 atomic % of silicon according to the invention.

FIG. 6 shows the result of a stability test for comparison of various resistors of the prior art and the resistor of the present invention. In the figure, the abscissa represents the time period of a shelf test and the ordinate represents the resistance change ratio $\Delta$ R/R. Line (A) represents the measured value of the tantalum-silicon alloy thin film resistor of the invention containing 67 atomic % of silicon (equivalent to $TaSi_2$) which is similar to the resistor in FIG. 1, which has been heat treated at 650° C in air. Line (B) represents, for comparison, the measured value of a tantalum nitride thin film resistor currently available on the market, which has been heat treated under the same condition as the above. Line (C) represents, for reference, the measured value of Ni-Cr alloy thin film resistor available on the market, which has been heat treated under the same condition as above. As is apparent from the figure, the tantalum-silicon resistor of the invention is superior in stability by a factor of about 5 relative to the tantalum nitride resistor, and by a factor of 20 –100 relative to the Ni-Cr resistor.

According to the method of the invention, tantalum-silicon alloy resistors having high specific resistance values as well as such high stability as shown above can be obtained by sputtering tantalum-silicon to form a thin film and heat treating the as-sputtered film at 500°–750° C.

Also, according to the method of the invention, resistors having a small temperature coefficient of resistance can be obtained by sputtering tantalum-silicon to form a thin film and heat treating the as-sputtered film at 500°–750° C.

Now, considering the practical range of ± 100ppm/° C with respect to the temperature coefficient of resistance required for metal thin film resistors, or −200ppm° C with respect to the temperature coefficient of resistance required for the resistor in the CR circuit of a tantalum thin film circuit, for the most stable heat treatment for realizing such temperature coefficient of resistance, the corresponding composition range of the tantalum-silicon alloy will naturally be determined. That is, the composition corresponding to a temperature coefficient of resistance of +100 to −200 ppm/° C and to the curve B′ in FIG. 1, i.e. a composition with silicon in a range of 50–72 atomic % is most preferred.

As is above described in detail, according to the invention, by heat treating a tantalum-silicon alloy thin film containing 50–72 atomic % of silicon at 500°–750° C in a vacuum or inert gas atmosphere, resistance which are extremely high in stability, high in specific resistance and low in temperature coefficient of resistance can be obtained, which resistors are extremely suitable for the requirements at the present time. In addition, the invention has a prominent feature of advantage that the heat treatment of the sputtered tantalum-silicon alloy thin film can be performed in air or an oxidizing gas ambient atmosphere as well as in a vacuum or inert gas under the same conditions.

What is claimed is:

1. A method for manufacturing a stable metal thin film resistor comprising:
   a. sputtering tantalum-silicon upon a substrate to form an amorphous tantalum-silicon alloy film containing from 50 to 72 atomic percent of silicon, and
   b. completely crystallizing the sputtered amorphous film by heat-treating the same at a temperature within the range of 500°–750° C. for a time period ranging from 1 to 60 minutes in an ambient atmosphere selected from the group consisting of air and an oxidizing gas.

2. A method as set forth in claim 1 wherein said amorphous tantalum-silicon alloy film is crystallized by heating the same at 650° C. for 15 minutes in air under a pressure of 1 atm.

3. A method as set forth in claim 1 wherein said amorphous tantalum-silicon alloy film contains 67 atomic percent of silicon.

4. A method for manufacturing a stable metal thin film resistor comprising:
   a. preparing a tantalum plate and a single crystal semiconductor silicon plate,
   b. adjusting the ratio of areas of the plates so that the resulting alloy thin film after sputtering contains from 50 to 72 atomic percent of silicon, c. co-sputtering the thus adjusted plates in a bipolar sputtering system upon a substrate to form an amorphous tantalum-silicon alloy film, and d. completely crystallizing the co-sputtered amorphous film and forming an oxide layer on the surface of the thus crystallized film by heat-treating said amorphous film at a temperature within the range of 500°–750° C. for a time period ranging from 1 to 60 minutes in an ambient atmosphere selected from the group consisting of air and an oxidizing gas.

5. A stable metal thin film resistor consisting of a sputtered tantalum-silicon alloy film containing from 50 to 72 atomic percent of silicon deposited upon a substrate and having a temperature coefficient of resistance of a low value within the range of +100 to −200 ppm/° C., said metal thin film resistor having been completely crystallized by heat-treating the same at a temperature within the range of 500°–750° C. for a time period ranging from 1 to 60 minutes in an ambient atmosphere selected from the group consisting of air and an oxidizing gas.

6. A stable metal thin film resistor as set forth in claim 5 wherein said sputtered film contains 67 atomic percent of silicon.

* * * * *